US009163412B2

(12) United States Patent
Schaefer

(10) Patent No.: US 9,163,412 B2
(45) Date of Patent: Oct. 20, 2015

(54) ALIGNABLE FOAM BOARD

(71) Applicant: Fiber Cement Foam Systems Insulation, LLC, Manalapan, NJ (US)

(72) Inventor: Russ Schaefer, Manalapan, NJ (US)

(73) Assignee: Fiber Cement Foam Systems Insulation, LLC, Manalapan, NJ (US)

( * ) Notice: Subject to any disclaimer, the term of this patent is extended or adjusted under 35 U.S.C. 154(b) by 0 days.

(21) Appl. No.: 13/942,022

(22) Filed: Jul. 15, 2013

(65) Prior Publication Data

US 2014/0157687 A1 Jun. 12, 2014

Related U.S. Application Data

(63) Continuation of application No. 13/569,834, filed on Aug. 8, 2012, now Pat. No. 8,590,236, which is a continuation-in-part of application No. 13/029,336, filed on Feb. 17, 2011, now Pat. No. 8,448,401.

(60) Provisional application No. 61/305,255, filed on Feb. 17, 2010.

(51) Int. Cl.

| | |
|---|---|
| ***E04D 1/00*** | (2006.01) |
| ***E04F 13/08*** | (2006.01) |
| ***E04C 2/30*** | (2006.01) |
| ***E04F 13/09*** | (2006.01) |

(52) U.S. Cl.

CPC ..... *E04F 13/0869* (2013.01); *E04C 2/30* (2013.01); *E04F 13/0823* (2013.01); *E04F 13/0875* (2013.01); *E04F 13/09* (2013.01)

(58) Field of Classification Search

USPC ..... 52/309.5, 309.12, 410, 417, 459–462, 52/478, 519, 521, 533, 540, 551, 747.1, 52/747.11, 748.1, 748.11, 105, 302.3, 52/302.4, 302.1, 506.01

See application file for complete search history.

(56) References Cited

U.S. PATENT DOCUMENTS

| | | | | |
|---|---|---|---|---|
| 1,655,494 | A | 1/1928 | Cowan | |
| 2,231,007 | A | 2/1941 | Vane | |
| 2,264,546 | A | 12/1941 | Ochs | |
| 2,264,961 | A | 12/1941 | Ward | |
| 3,318,056 | A | 5/1967 | Thompson | |
| RE27,502 | E | 10/1972 | Martin | |
| 3,826,054 | A | 7/1974 | Culpepper, Jr. | |
| 3,998,021 | A | 12/1976 | Lewis | |
| 4,320,613 | A | 3/1982 | Kaufman | |
| 5,390,459 | A * | 2/1995 | Mensen | 52/426 |
| 5,657,600 | A | 8/1997 | Mensen | |
| 5,878,543 | A | 3/1999 | Mowery | |
| 6,161,353 | A | 12/2000 | Negola et al. | |
| 6,263,574 | B1 | 7/2001 | Lubker, II et al. | |
| 6,355,700 | B1 | 3/2002 | Uekado | |
| 6,418,610 | B2 | 7/2002 | Lubker, II | |
| 6,688,073 | B2 | 2/2004 | VanderWerf et al. | |

(Continued)

FOREIGN PATENT DOCUMENTS

JP WO 9900243 A1 1/1999

*Primary Examiner* — Brian D Mattei

(74) *Attorney, Agent, or Firm* — Gearhart Law, LLC

(57) ABSTRACT

A shaped insulating board is disclosed for enabling lining of fiber cement boards and simultaneously enabling attachment of the insulating board on the building studs. Furthermore, the shaped insulating board provides a water drainage panel that allows water to drain downward on both sides of the board. The shaped insulating board also provides aeration between the board and the building surface.

8 Claims, 4 Drawing Sheets

(56) References Cited

U.S. PATENT DOCUMENTS

| | | | |
|---|---|---|---|
| 6,715,240 | B2 | 4/2004 | Beck |
| 6,990,775 | B2 | 1/2006 | Koester |
| 7,040,067 | B2 | 5/2006 | Mowery |
| 7,043,887 | B2 | 5/2006 | Van Ootmarsum |
| 7,127,869 | B2 | 10/2006 | Perry |
| 7,188,454 | B2 | 3/2007 | Mowery |
| 7,836,652 | B2 | 11/2010 | Futterman |
| 2003/0074854 | A1 | 4/2003 | Nordgren et al. |
| 2006/0053740 | A1 | 3/2006 | Wilson et al. |
| 2006/0075712 | A1 | 4/2006 | Gilbert et al. |
| 2006/0156668 | A1 | 7/2006 | Navsik |
| 2007/0011976 | A1 | 1/2007 | Mowery |
| 2007/0175159 | A1 | 8/2007 | Miniter |
| 2007/0186501 | A1 | 8/2007 | Kuelker |
| 2007/0294970 | A1 | 12/2007 | Marshall et al. |
| 2008/0313991 | A1 | 12/2008 | Chouinard |
| 2009/0064599 | A1 | 3/2009 | Bennett |
| 2009/0064606 | A1 | 3/2009 | Ceria |
| 2009/0239430 | A1 | 9/2009 | Egan et al. |
| 2010/0101159 | A1* | 4/2010 | Gleeson et al. ..... 52/105 |
| 2010/0319288 | A1 | 12/2010 | Morse et al. |

* cited by examiner

ALIGNABLE FOAM BOARD

CLAIM OF PRIORITY

This application is Continuation of U.S. patent application Ser. No. 13/569,834 filed on Aug. 8, 2012 and claiming priority of U.S. Pat. No. 8,448,401 filed as application Ser. No. 13/029,336 on Feb. 17, 2011 which claims priority to U.S. Ser. No. 61/305,255 filed Feb. 17, 2010, the contents of all of which are fully incorporated herein by reference.

FIELD OF THE INVENTION

The invention relates to the installation of building siding, and more particularly to insulation board and processes related to installing the insulation.

BACKGROUND OF THE INVENTION

Houses in America often have their exterior walls clad with siding to protect the predominately wooden construction from the elements. Vinyl siding has become particularly popular over the last several decades as it is inexpensive, relatively easy to clean and relatively durable. However, in recent years, fiber cement siding has begun to replace vinyl siding. Fiber cement is a product made of sand, cement and cellulose. As a siding material, fiber cement has advantages over both wood and vinyl in that it is rot resistant, termite resistant and non-combustible. Because of these properties fiber cement siding has become widely used in bush fire regions of Australia, and is now becoming a material of choice for new construction in the United States also. Fiber cement siding can also be painted and can be made to look like wood. Its one significant disadvantage is that the fiber cement planks used in the siding are relatively heavy and need to be placed one at a time. Any method of making their alignment easier is, therefore, of great practical utility.

On the other hand vinyl and other types of building siding remain common and insulation at the times of high energy costs has become an important consideration. Therefore, there is a need of insulation practical to use with vinyl and other types of building sidings as well as fiber cement siding.

The system and method of this invention provide both increased thermal insulation and significantly simple installation of the insulation. Furthermore the invention provides an alignment of the fiber cement planks when fiber cement siding is used. The simplified insulation does not compromise the thermal insulation but makes the system more affordable and time saving.

DESCRIPTION OF THE RELATED ART

The relevant patent literature involving siding alignment and insulation products and processes include:

U.S. Patent Publication Number 2009/0019814 is directed to a panelized cladding system including a plurality of battens securable to a building structure, each batten having a structure engaging surface and an integrally formed finish ready panel supporting surface. Fiber cement cladding panels are secured to or through the battens such that the finish ready panel supporting surface of each batten forms an external recessed surface of an expressed joint formed thereon.

U.S. Pat. No. 6,418,610 relates to a method for using a support backer board system and siding. The support backer board system comprises at least a first layer. The first layer is made from a material selected from the group consisting of alkenyl aromatic polymers, polyolefins, polyethylene terephthalate, polyesters, and combinations thereof. The board system is thermoformed into a desired shape with the desired shape being generally contoured to the selected siding. The siding is attached to the board system so as to provide support thereto. In one process, the siding may be vinyl.

U.S. Pat. No. 8,091,313 discloses an apparatus and method for a drainage system of an exterior wall of a building comprising insulation having a rear face for contact with the exterior wall of the building and a drainage plane positioned on the rear face for removal of water from the exterior wall.

CA 2,742,046 discloses an insulation system for securing cladding to the exterior surface of a building. An insulated panel has a front face and a rear face. Joining elements are defined in horizontal edges of the panel for connecting adjacent panels to each other. A horizontal attachment member, such as a nailing hem, is mounted to the rear face of the panel for attaching the insulated panel to the exterior surface. Receiving members are present on the front face of the panel, and can be located in receiving channels. The receiving member is generally made from a material that is better at retaining fasteners, such as nails, than the material of the insulated panel itself.

U.S. Pat. No. 7,762,040 discloses a method for installing siding panels to a building including providing a foam backing board having alignment ribs on a front surface and a drainage grid on a back surface and then establishing a reference line at a lower end of the building for aligning a lower edge of a first backing board an tacking thereon. The system includes tabs and slots along vertical edges of the foam backing board to align and secure adjacent backing boards to each other. A siding panel is butted against one of the lower alignment ribs and secured thereto. Another siding panel is butted against and secured to the adjacent alignment rib to form a shadow line between the adjacent siding panels on the building.

U.S. 20100251648, 2011021073, 20110271622, and US20110271624 disclose foam backing panels for use with lap siding and configured for mounting on a building. The foam backing panels comprise a rear face configured to contact the building, a front face configured for attachment to the lap siding, alignment means for aligning the lap siding relative to the building, means for providing a shadow line, opposing vertical side edges, a top face extending between a top edge of the front face and rear face and a bottom face extending between a bottom edge of the front face and rear face.

The existing art does not provide sufficient protection against moisture drainage of building structures, sufficient aeration between the building surface and the insulation, nor a method or means to easily align drainage panels or attach the insulation boards.

Various implements are known in the art, but fail to address all of the problems solved by the invention described herein. One embodiment of this invention is illustrated in the accompanying drawings and will be described in more detail herein below.

SUMMARY OF THE INVENTION

The present invention relates to an apparatus that forms an insulating barrier behind building siding. The siding may be of any material, vinyl siding, wood siding, fiber cement siding or any other siding material.

In U.S. patent application Ser. No. 13/029,336 and corresponding provisional application 61/305,255, the contents of both of which are incorporated herein by reference, the inventor provided an easy to install shaped insulation board with a separate two sided water drainage panel. The inventor has now developed the product further, and provides here an insulation board that in it self may act as two sided water drainage panel and simultaneously allows aeration between the board and the building surface.

According to one preferred embodiment the siding is fiber cement siding and the insulation also acts as an installation guide that aids in attaching fiber cement planks or boards that form the siding.

In a preferred embodiment, a rectangular insulating board made of a suitable thermal insulating material has a substantially flat, rectangular back surface including multiple drainage areas for water draining.

The substantially flat back surface of the insulation board has a plurality of molded drainage areas. The drainage areas consist of vertically positioned drainage grooves and ridges and the drainage areas are separated from each other by inner stud ridges that are designed to coincide with the building studs for attachment of the board. The inner stud ridges may also be designed to be higher than the drainage ridges, whereby the system leaves an aeration space between the drainage areas and building surface when the board is attached on the building studs.

The front surface has preferably one or more stud marking areas. The stud marking areas may contain vertically running stud marking grooves that may also act as water drainage channels but also enable easy lining of the boards plus guide attachment to the studs. The stud marking areas may contain other markings for attachment to the studs as well, such a nail spots, letters, numbers, or color codes.

The front surface may be shaped to form a number of flat-faced, protruding horizontal ridges. The protruding ridges are preferably aligned substantially parallel to an edge of the rectangle. A cross-section, taken orthogonal to the alignment of the protruding ridges, has a saw-tooth shape. The front side of the board also includes means to guide attachment to the building studs.

The protruding horizontal ridges are shaped and sized so that the following may be done. A standard-size, fiber cement plank, or board, may be placed face-down on a long face of a protruding ridge of the shaped insulating board. The fiber cement board may be positioned to have its long edge abutting the short face of an adjacent protruding ridge. A second fiber cement board of a similar size may then be placed face-down on a long face of the adjacent protruding ridge. When the second fiber cement board is positioned to have its long edge abut the short face of the next adjacent ridge, the second board may then overlap the first fiber cement board. The overlap is such that the underside face of the overlap of the second board lies flat on the upper face of the first board. The invention of this disclosure also comprises shaped flashing elements that are sandwiched between the insulation board and the fiber cement boards to provide water protection in areas where two insulation boards are abutting either horizontally or vertically. The shaped insulating board is aligned on the wall to a required orientation. The required orientation is preferably the orientation in which the protruding ridges are aligned in the same direction as the desired orientation of the length of the fiber cement board when it is attached.

An aspect of the instant invention in addition to provide a guidance system for installation of the cement boards is to provide an insulation board that allows efficient water drainage and aeration. Furthermore, the instant invention not only provides guidance for installing the cement boards, but provides guidance to easily align the drainage channels and to attach the insulating boards on the building studs.

Once the shaped insulating board is attached to the wall, it may then serve as a guide for positioning the fiber cement board. The fiber cement board may be positioned by abutting its long side against a short edge of one of the protruding ridges, with the fiber cement board's face against the long face of an adjacent protruding ridge. The fiber cement board is then correctly aligned and may be slid along the ridge edge until it is in place for attaching to the wall. The attachment may, for instance, be by means of a fastener such as, but not limited to, nails, screws, bolts or some combination thereof.

Therefore, the present invention succeeds in conferring the following, and others not mentioned, desirable and useful benefits and objectives.

It is an object of the present invention to provide a shaped insulating board for attachment on building studs, having a vertical cross section, a horizontal cross section, a front surface and a substantially flat back surface, wherein the back surface is forming a molded drainage panel, said drainage panel comprising a multitude of drainage areas, each drainage area being formed by vertical drainage ridges and drainage grooves, and each drainage area being separated from each other by an inner stud ridge, said vertical ridges and grooves running from an upper end of the back surface to a lower end of the back surface, and said stud ridges located from each other at distance such that a multiplication of the distance equals to the distance between building studs, whereby each building stud coincides with one stud ridge, and the front surface comprising markings for attachments on building studs, said markings coinciding with stud ridges on the back surface.

It is another object of the present invention to provide fiber cement siding system comprising:

a multitude of fiber cement boards; a shaped insulating board, having a vertical cross section, a horizontal cross section, a shaped front surface and a substantially flat back surface, the front surface being formed of horizontally aligned ridges having a short face and a long face, the short face of one ridge being joined in an angle to the long face of an adjacent ridge, whereby the vertical cross section has a substantially saw tooth like edge toward the front surface and a flat edge toward the back surface, the front surface further comprising a plurality of stud marking areas, each stud marking area consisting of vertically oriented stud marking grooves running across the horizontally aligned ridges from an upper end of the front surface to a lower end of the front surface, said vertically oriented grooves being separated from each other by an outer stud ridge, and the stud marking areas being separated from each other by clearance ridges, said clearance ridges having a width equaling to a distance between building studs, the back surface having a molded drainage panel, said drainage panel comprising a multitude of drainage areas, each drainage area being formed by vertical drainage ridges and drainage grooves, and each drainage area being separated from each other by an inner stud ridge, said vertical ridges and grooves running from an upper end of the back surface to a lower end of the back surface, and said inner stud ridge coinciding with the outer stud ridge, whereby the horizontal cross section of the insulating board has non grooved stud ridge areas in between of grooved drainage areas, and said non grooved stud ridge areas locate from each other at distance equaling to the distance between building studs; and a multitude of flashing elements, said flashing elements consisting of a first rectangle having a short edge substantially equal in length to the width of the short face of the protruding ridge of the front surface of the shaped insulating board, a second rectangle having a long edge longer than the long face of the protruding ridge of the shaped insulating board, and a short edge having a length substantially equal to a long edge of the first rectangle, and wherein the long edge of the first rectangle forms a substantially contiguous join with the short edge of the second rectangle in an angle matching the angle of the joint of the short and the long face of adjacent protruding ridges of the front side of the shaped insulating board.

It is an object of the present invention to provide a thermal insulation including an efficient drainage system.

It is another object of the present invention to provide thermal insulation with drainage panels that allows proper aeration between the insulation and the building surface.

It is a further object of the present invention to provide a system to align the drainage channels of abutting insulation boards.

Another object of the present invention is to easily enable attachment of the insulation board onto the building studs.

It is an object of the present invention to provide additional thermal insulation to houses.

It is an object of the present invention to prevent water damage to building structures.

It is another object of the present invention to provide a tool for rapid positioning of fiber cement boards.

Yet another object of the present invention is to provide quicker, and therefore less expensive, installation of fiber cement siding.

BRIEF DESCRIPTION OF THE DRAWINGS

FIG. 4 A. shows an isometric view of the substantially flat back surface of one embodiment of the shaped insulating board of the present invention having a series of drainage areas separated by stud ridges. The vertical cross section in this embodiment is saw tooth like.

FIG. 4 B shows an isometric view of the substantially flat back surface of another embodiment of the shaped insulating board of the present invention having a series of drainage areas separated by stud ridges. The vertical cross section in this embodiment is not saw tooth like.

DESCRIPTION OF THE PREFERRED EMBODIMENTS

Figure 1:
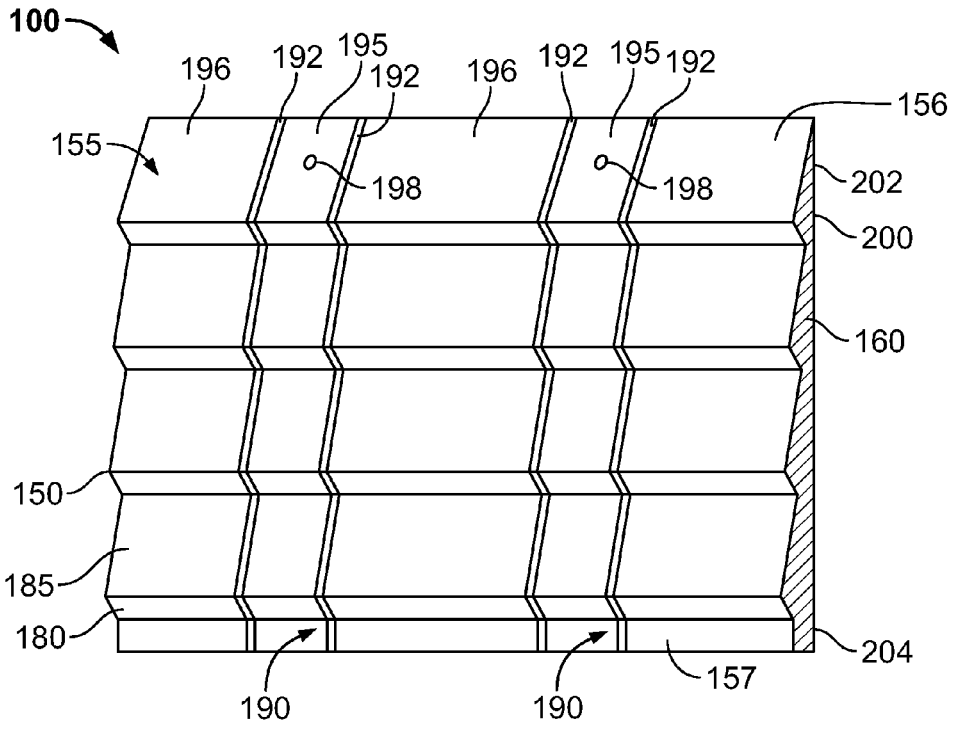
FIG. 1 shows an isometric view of a preferred embodiment of a shaped insulating board of the present invention.

The preferred embodiments of the present invention will now be described with reference to the drawings. Identical elements in the various figures are identified with the same reference numerals.

Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

FIG. 1 shows an isometric view of a preferred embodiment of a shaped insulating board of the present invention. FIG. 1 shows the shaped insulating board 100, the front surface 155, the upper end of the front surface 156, the lower end of the front surface 157, the back surface 200, the upper end of the back surface 202, the lower end of the back surface 204, protruding ridges of the front surface 150, vertical stud marking areas 190, the front surface, stud marking grooves 192, clearance ridge 196 between the stud marking areas, outer stud ridge 195 separating the stud marking grooves 192, and markings for attachment 198 on the outer stud ridges.

Figure 2:
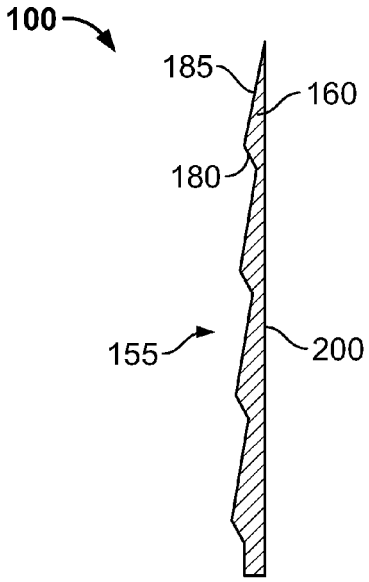
FIG. 2 shows a vertical cross-sectional view of a preferred embodiment of a shaped insulating board of the present invention.

FIG. 2 shows a vertical cross-sectional view of a preferred embodiment of a shaped insulating board of the present invention. The figure shows the shaped insulating board 100, the front surface 155, the back surface 200, and the saw-tooth shaped vertical cross section 160. The long face of protruding ridges 185 and the short face of the protruding ridges are also shown.

FIG. 3 A shows a horizontal cross-sectional view of a preferred embodiment of a shaped insulating board of the present invention. The figure shows the building studs 125, the building surface 105, the horizontal cross section 170, the back surface 200, the front surface 155, the stud marking grooves 192, the outer stud ridge 195, the clearance ridges 196 between the stud marking areas, the drainage areas 300, the inner stud ridges 305, the drainage grooves 310, and the drainage ridges 320.

Figure 3A:
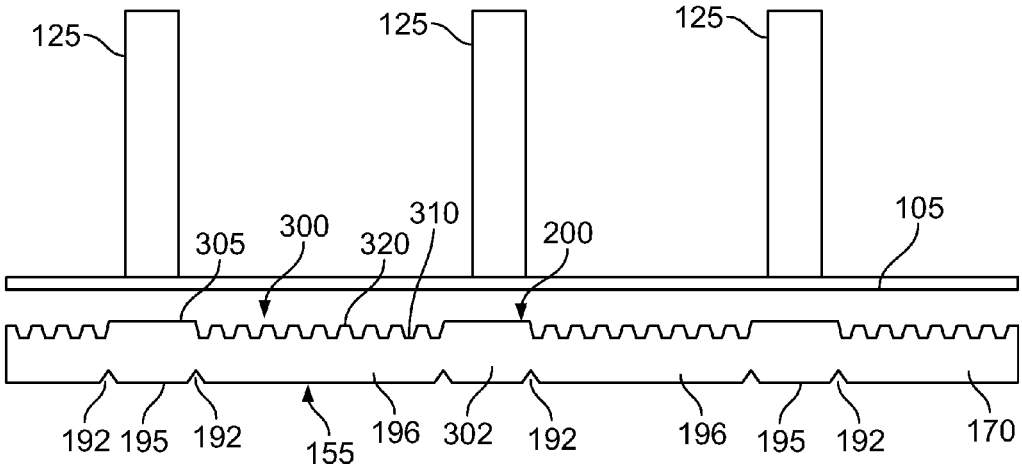
FIG. 3A shows a horizontal cross-sectional view of a preferred embodiment of a shaped insulating board of the present invention.
Figure 3B:
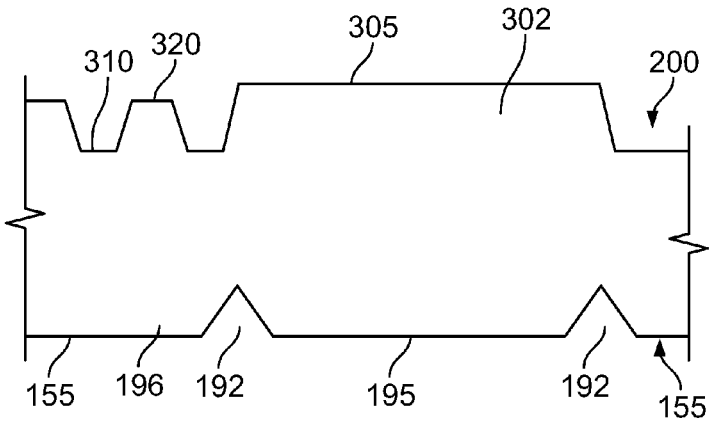
FIG. 3B is an enlarged detail of the grooves and ridges on the cross section shown in FIG. 3A.

FIG. 3B shows an enlarged detail of the horizontal cross-section of the shaped insulating board of FIG. 3A. The figure shows the back surface 200, the front surface 155, the stud marking grooves 192, the inner stud ridge 195, the clearance ridge 196, drainage groove 310, drainage ridge 320 and inner stud ridge 305.

Figure 4A:
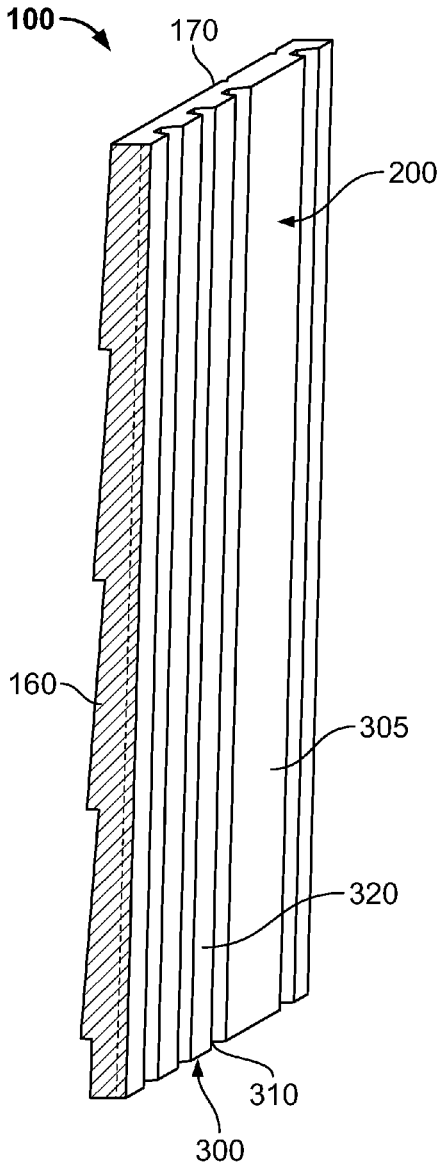

FIG. 4 A shows an isometric view of the back surface with stud markings according to one embodiment. The figure shows the back surface 200, the vertical saw tooth like cross section 160, the horizontal cross section 170, the drainage areas 300, the drainage grooves 310, the drainage ridges 320 and the inner stud ridges 305.

FIG. 4 B shows an isometric view of the back surface with stud markings of another embodiment where the front side does not have the protruding ridges and accordingly the vertical cross section is not saw tooth like. The figure shows the back surface 200, the vertical cross section 160, the horizontal cross section 170, the drainage areas 300, the drainage grooves 310, the drainage ridges 320, an optional diagonal groove 303, and the inner stud ridges 305.

Figure 5:
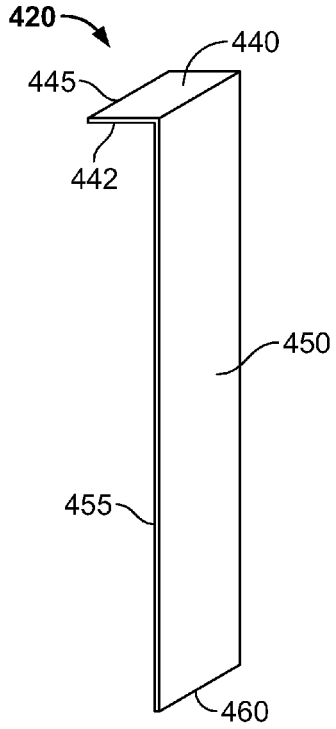
FIG. 5 shows an isometric view of a shaped flashing element of the present invention.

FIG. 5 shows an isometric view of a shaped flashing element of the present invention. The figure show the flashing element 420, the first rectangle 440, the second rectangle 450, the long edge of the second rectangle 455, the short end of the second rectangle 460, the short end of the first rectangle 442, and the long end of the first rectangle 445.

Figure 6:
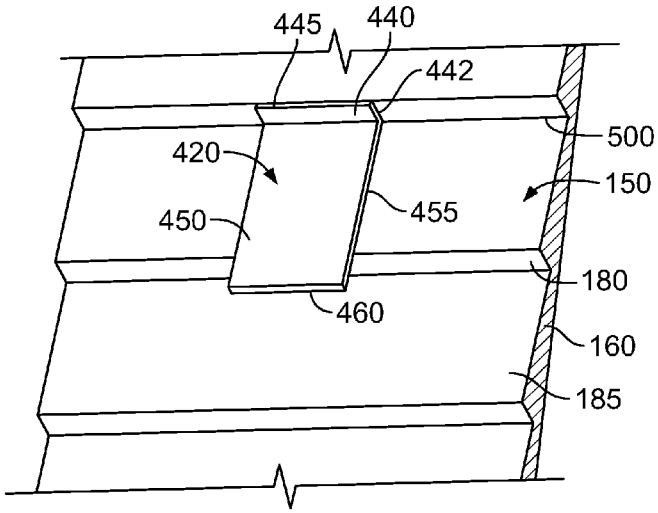
FIG. 6 shows an isometric view of shaped flashing elements placed to cover a horizontal gap between two adjacent shaped insulating boards.

FIG. 6 shows the shaped flashing elements placed to cover a horizontal gap between two adjacent shaped insulating boards. The figure shows the horizontal gap 500 between the boards, the flashing element 420, the first rectangle 440, the second rectangle 450, the short end of the first rectangle 442, the long end of the first rectangle 445, the long end of the second rectangle 455, the short end of the second rectangle 460, the protruding ridges of the front surface 150, the long face of protruding ridges 185, and the short face of protruding ridges 180.

Figure 7:
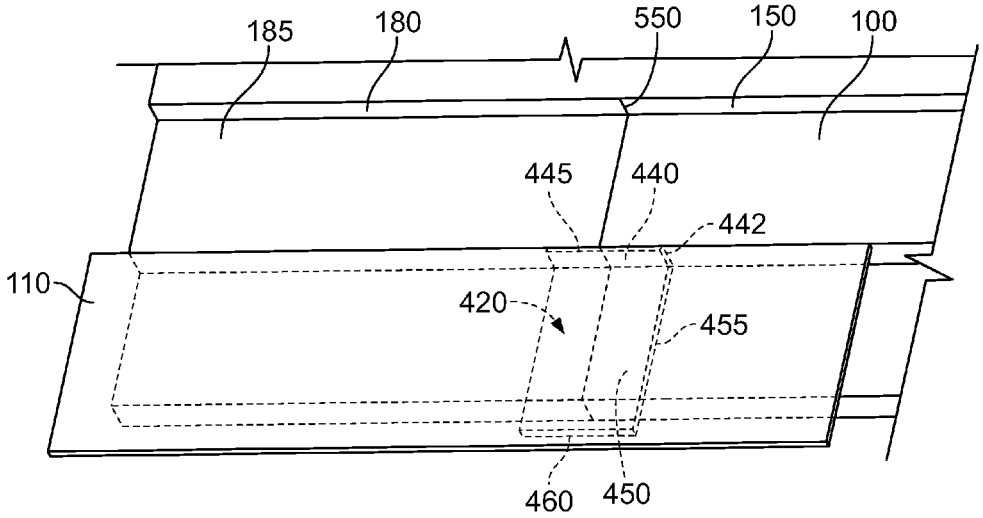
FIG. 7 shows an isometric view of shaped flashing elements sandwiched between fiber cement boards and shaped insulating board and covering a vertical gap between two adjacent shaped insulating boards.

FIG. 7 shows the flashing elements sandwiched between fiber cement boards 110 and shaped insulating board 100 and covering a vertical gap 550 between two adjacent shaped insulating board. The figure shows the vertical gap 550, fiber cement boards 110, flashing element 420, the first rectangle 440, the second rectangle 450, the long end of the first rectangle 445, the short end of the first rectangle 442, the long end of the second rectangle 455, the short end of the second rectangle 460, the protruding ridges of the front surface 150, the long face of protruding ridges 185, and the short face of protruding ridges 180.

Now referring to FIGS. 1 and 2, the shaped insulating board 100 has a rectangular, substantially flat back surface 200. In one preferred embodiment the vertical cross section 160 is saw tooth-like and on the front surface 155, the shaped insulating board 100 is shaped to have a series of substantially identical, flat-faced protruding ridges 150. The size and shape of these protruding ridges 150 is largely defined by the dimensions of the standard fiber cement boards 110 typically used for exterior wall siding, for instance, on domestic houses. Further, the front surface 155 of the shaped insulating board 100 has vertical stud marking areas 190. A stud marking area 190 consists preferably of two vertically running stud marking grooves 192 separated by an outer stud ridge 195. Alternatively, only one stud marking groove 192 may be used. It is also possible to have more than two stud marking grooves. A skilled artisan would understand that it is in the spirit of this invention to have an insulating board where the front surface does not have the protruding ridges 150 but only the stud marking areas (shown in FIG. 4B). Such a board would be practical to use for example with vinyl- or wood sidings. The width of the outer stud ridges 195 when measured from the middle of one stud marking groove 192 to middle of the second stud marking groove 192, is determined by the width of the building studs 125 and is between 1 and 4 inches, preferably between 1 and 2 inches, and most preferably 1.5" (3.81 cm), but the width may also be larger or smaller. The stud marking areas 190 are separated by clearance ridges 196. The width of the clearance ridge 196 is determined by the distance between building studs 125. The standard distance between building studs is 16 or 24 inches (40.64 or 60.96 cm) from stud center to stud center. Accordingly, in the preferred embodiment the width is such that a multiplication of the width would equal with the distance between building studs. In a most preferred embodiment the with of the clearance ridges 196 is 2, 4, 8, 16, or 24 inches, whereby there is always one stud ridge 195 coinciding with each building stud 125 and therefore guide installation of the shaped insulating board 100. One skilled in the art would appreciate that it is within the scope of this invention to vary the width of the clearance ridges long as there is one stud ridge 195 coinciding with each building stud 125. According to a preferred embodiment the width of the clearance ridges is 16 inches for buildings where the distance between studs is 16 inches, and 24 inches where the distance between the studs is 24 inches. The stud marking areas 190 of the instant invention also helps aligning horizontally abutting insulation boards so that drainage areas and drainage grooves on the back side of the boards are aligned. Furthermore the stud marking areas 190 enable to position the insulation boards 100 so that they are easy to attach with nails or other means to the studs 125. According to one preferred embodiment, the outer stud ridges 195 have markings for the attachment 198. In the embodiments where the width of the clearance area is smaller than the distance between the studs, the markings for attachment 198 are so designed that they locate only on those stud ridges that are to be attached to the studs. The markings may be, but are not limited to spots, lines, crosses, colored areas or other codes. According to one embodiment the front of the board may have letters or numbers and certain numbers or letters serve as markings for attachment 198. Certain codes may guide attachment to studs that are 16 inches apart from each other, while other codes may guide attachment to studs 24 inches apart from each other. According to one embodiment the codes may be letters which may be part of advertisement or other information.

Figure 4B:
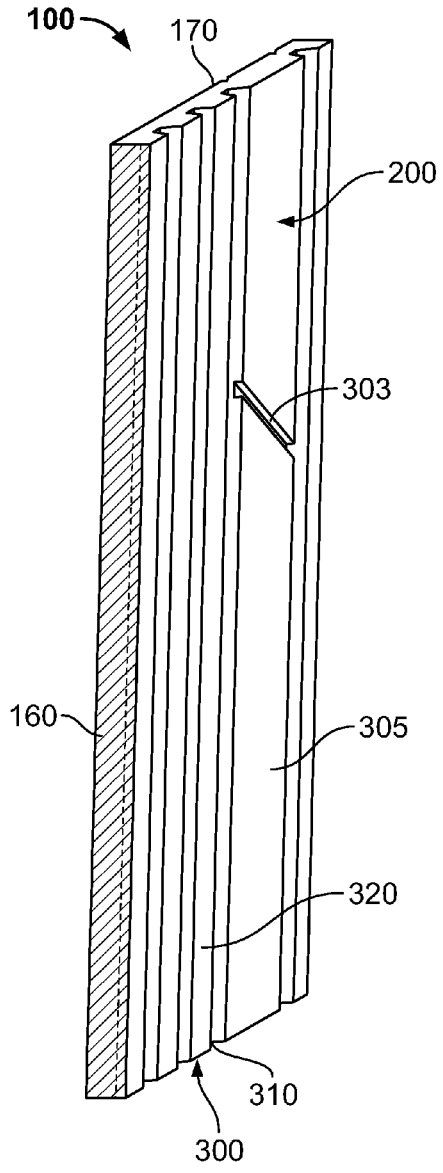

Now referring to FIGS. 4 A and B, the back surface 200 of the shaped insulating board has several drainage areas 300, each drainage area comprising several vertical drainage grooves 310 separated by drainage ridges 320. The drainage areas 300 are separated from each other by inner stud ridges 305. FIG. 4 A shows an embodiment where the front surface has the protruding ridges whereby the vertical cross section 160 is saw tooth like. FIG. 4 B shows another embodiment where the front surface does not have the protruding ridges and the vertical cross section 160 accordingly does not have the saw tooth like character. FIG. 4B also shows a diagonal groove 303. According to one embodiment the inner stud ridge 305 may contain one or more diagonal grooves 303 connecting the drainage areas.

Referring now to FIGS. 3A and 3B, the inner stud ridges 305 preferably coincide in location with the outer stud ridges 195, thereby the inner stud ridge and the corresponding outer stud ridge form a non grooved stud area 302 and the non grooved stud areas coincide with the location of the building studs 125. When the shaped insulating boards are attached to the building they can be easily attached along the non grooved stud areas 302 to the studs 125 for example with nails, screws or other similar means. As is shown in FIG. 3B, which shows the stud area 302 in details, it can be seen that the inner stud ridge 305 is preferably higher than the drainage ridges 320. This feature would allow an air space between the building surface 105 and the installed shaped insulating board 100, because the lower height of drainage ridges 320 would not allow them to touch the building surface 105 when the higher inner stud ridges 305 is aligned along and attached to the building studs 125. According to a preferred embodiment the height a drainage ridge 320 when measured from the bottom of adjacent drainage groove 310 to the top of the inner drainage ridge 320 is between 1/16 and 1/4 inches, more preferably about 1/8 inches and most preferably 1/8 inches (3.18 mm). An inner stud ridge 305 may be 1/16 to 1/4 inches higher than the drainage ridge, but preferably is 1/16 inches higher than the drainage ridge 320. Accordingly, preferably when the height of an inner drainage ridge 320 is measured from the bottom of a drainage grove 310 to the top of the inner drainage ridge 320, it would be 3/16 inches (4.76 mm) high, and the air space between the building surface 105 and the shaped insulating board 100 would be approximately 1/16 inches (1.18 mm). It is understood by a skilled artisan that the measures may be changed without departing the spirit of the invention.

According to one embodiment the board may contain one or more diagonally positioned grooves 303 across the inner stud ridge. Such diagonal grooves may connect the drainage grooves that locale on both sides of the inner stud ridge. Such an embodiment would provide improved water drainage.

The cross section of the stud marking grooves 192 and the drainage grooves 310 is preferably V-shaped, but it can also be U-shaped, or partially square shaped.

The shaped insulating board 100 may be made from any suitable thermal insulation that is also sufficiently rigid to support standard-sized fiber cement boards 110 during installation.

Suitable materials are insulation such as, but not limited to, polyolefin, polyethylene terephthalate, polyester, alkenyl aromatic polymer, polystyrenic resin and polystyrene, or some combination thereof. Preferably the insulation board is made of polystyrene foam. The board may be up to 2" (5.08 cm) thick. The size of the boards may vary. According to one preferred embodiment the board is about 4×4 feet (121×121 cm), but any other feasible size is within the scope of the invention.

The shaped insulating board 100 with the optional flat faced protruding ridges, stud markings and drainage areas is preferably shaped by using molding techniques but may be shaped by any method suitable to the material used including hot wire forming techniques such as, but not limited to preformed wire manufacture.

Now referring to FIGS. 5, 6 and 7, the instant invention comprises a shaped flashing element 420 to waterproof the horizontal 500 and vertical 550 gaps that are between adjacent shaped insulating boards 100. According to a preferred embodiment the shaped flashing element 420 is made of coated aluminum, but instead of aluminum other malleable materials such as copper, bronze, tin, or steel may also be used. The flashing element may also be made of plastic or polyethene. Preferably the flashing element is made of aluminum coated with an anticorrosion coating from both sides to avoid corrosion caused by the fiber cement. The shaped flashing element 420 may, for instance, be made by a process such as, but not limited to, molding, machining, bending or some combination thereof.

FIG. 5 illustrates the flashing element according to a preferred embodiment. The flashing element 420 has a first rectangle 440 and a second rectangle 450. The first rectangle 440 has a short edge 442 substantially equal in length to the width of the short face 180 of the protruding ridge 150. The second rectangle 450 has a long edge 455. The long edge 455 may be substantially equal in length to the width of the long face 185 of the protruding ridge 150 of the shaped insulating board 100, but according to a preferred embodiment the long edge 455 is longer than the width of the long face 185. According to a most preferred embodiment the long edge 455 is substantially equal in length to the width of the cement board 110. The short edge of the second rectangle 460 has a length substantially equal to the long edge of first rectangle 440. The long edge of the first rectangle 442 forms a substantially contiguous join with the short edge of the second rectangle 450 in an angle that matches the angle between adjacent protruding ridges 150 of the shaped insulating board 100.

FIG. 6 shows an isometric view of shaped flashing elements 420 placed to cover a horizontal gap 500 between two adjacent shaped insulating boards 100. FIG. 7 shows an isometric view of shaped flashing elements 420 placed to cover a vertical gap 550 between adjacent shaped insulation boards 100. As shown in FIGS. 6 and 7, the next step after attaching the shaped insulation board 100 on the building surface is a sandwich flashing elements between the insulation board 100 and the fiber cement boards 110 to cover horizontal 500 or vertical 550 gaps between two adjacent insulation boards 100. Once the fiber cement boards 110 are secured, the shaped flashing element 420 is held in place without any fastening elements. An advantage in this is to save material and on the other hand to save the flashing elements from any holes that would be created by nails or pins or other fastening means.

In a preferred embodiment, the shaped flashing element 420 may have a width in a range of 0.5 to 12 inches (1.27 cm to 30.48 cm) and a thickness in a range of less than 0.5 inches (1.28 cm). More preferably, the shaped flashing element 420 may have a width in a range of 1 to 3 inches (2.54 to 7.62 cm) and a thickness in a range of less than 0.125 inches (3.18 mm). According to a preferred embodiment the long edge of the second rectangle 455 is preferably between 5 and 8 inches (12.70 to 20.32 cm), but the length primarily depends on the width of the fiber cement planks.

According to one embodiment of this invention, a water proof sheet may be attached on the building surface 105 before attaching the shaped insulating boards 100. Such water proof sheet may be made of any suitable waterproof or water-resistant for creating a vapor barrier such as, but not limited to, aluminum foil, paper-backed aluminum, polyethylene plastic sheet, a metalized film, or some combination thereof.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A single shaped insulating foam board for attachment to building studs having a vertical cross section, a horizontal cross section, a substantially flat front surface, a substantially flat back surface, and four flat edges extending from the front surface to the back surface, wherein the back surface forming a drainage panel, said drainage panel comprising a multitude of drainage areas, each drainage area being formed by vertical drainage ridges and drainage grooves, and each drainage area being separated from each other by an inner stud ridge, said vertical ridges and grooves running from an upper end of the back surface to a lower end of the back surface, wherein at least one inner stud ridge coincides with a building stud, and the substantially flat front surface comprising markings for attachments on the building studs, said markings coinciding with those inner stud ridges on the back surface that coincide with the building studs, and said markings being separated from each other by clearance ridges and wherein a height of the drainage ridges when measured as a distance from a bottom of a drainage groove to a top of an adjacent drainage ridge is smaller than a height of the inner stud ridges when measured as a distance from a bottom of a drainage groove to the top of an adjacent inner stud ridge.

2. The shaped insulating board of claim 1, wherein the markings include different codes and one code indicate attachment to studs that are 16" apart from each other and another code indicates attachment to studs that are 24" apart from each other.

3. The shaped insulating board of claim 2, wherein the height of the drainage ridges is 1/16 inches smaller than the height of the inner stud ridge.

4. The shaped insulating board of claim 1, wherein the clearance ridges have a width of 16 or 24 inches.

5. The shaped insulating board of claim 1, wherein the inner stud ridge has a width of about 1.5 inches.

6. The shaped insulating board of claim 1, wherein the drainage grooves have a cross section selected from the group consisting of U-shaped, V-shaped and partially square-shaped.

7. The shaped insulating board of claim 6, wherein the drainage grooves have a depth of 1/16 inches.

8. The shaped insulating board of claim 6, wherein the drainage grooves have a width of ⅝ inches and the drainage ridges have a width of ¼ inches.

* * * * *